US005341201A

United States Patent [19]

Kedarnath et al.

[11] Patent Number: 5,341,201

[45] Date of Patent: Aug. 23, 1994

[54] XEROGRAPHIC BRUSH CLEANER DETONER

[75] Inventors: N. Kedarnath, Fairport; Samuel P. Mordenga, Rochester, both of N.Y.

[73] Assignee: Xerox Corporation, Stamford, Conn.

[21] Appl. No.: 990,391

[22] Filed: Dec. 14, 1992

[51] Int. Cl.[5] ..... G03G 21/00

[52] U.S. Cl. ..... 355/302; 15/256.52; 118/652

[58] Field of Search ..... 355/301, 302, 303, 304; 15/256.5, 256.51, 256.52, 308, 309; 118/652

[56] References Cited

U.S. PATENT DOCUMENTS 3,942,889 3/1976 Kurita et al. .
4,054,381 10/1977 Bernhard .
4,304,026 12/1981 Borostyan ..... 15/308
4,411,042 10/1983 Sakata et al. .
4,878,093 10/1989 Edmunds ..... 355/296
5,200,788 4/1993 Thayer ..... 355/298

FOREIGN PATENT DOCUMENTS 59-84278 5/1984 Japan .

OTHER PUBLICATIONS

Research Disclosure Bulletin, Dec. 1975, No. 14033, p. 43, "A Half Tone Screen Device".

*Primary Examiner*—R. L. Moses
*Attorney, Agent, or Firm*—T. L. Fair

[57] ABSTRACT

An apparatus for detoning a cleaner brush by providing multiple opportunities for fiber detoning to take place. A screen detoning element located in the cleaner housing causes multiple interferences with the brush fibers bringing about a high degree of detoning of the cleaner brush.

7 Claims, 3 Drawing Sheets

XEROGRAPHIC BRUSH CLEANER DETONER

BACKGROUND OF THE INVENTION

This invention relates generally to an electrostatographic copier or printer, and more particularly, concerns a cleaning apparatus. In an electrophotographic application such as xerography, a charge retentive surface (i.e. photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (i.e. an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g. paper), and the image affixed thereto to form a permanent record of the image to be reproduced. Subsequent to development, excess toner left on the charge retentive surface is cleaned from the surface. This process is well known, and useful for light lens copying from an original, and printing applications from electronically generated or stored originals, where a charge surface may be imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. Toner particles adhere to the fibers (i.e. bristles) of the brush after the charge retentive surface has been cleaned. The process of removing toner from these types of cleaner brushes can be accomplished in many ways. Typically, brush cleaners, use flicker bars to provide the detoning function. A flicker bar is usually a thin long bar with a controlled amount of interference with the brush fibers. When the fibers encounter the flicker bar, the fibers bend and the impact dislodges toner particles adhering to the fibers. Once released, these particles may be carried away by an airstream to a toner filter or separator. The disadvantage of this method is that the brush fibers have just one chance or revolution for detoning. This results in partial detoning of the fibers and a gradual accumulation of toner in the brush. When the amount of toner accumulated in the brush exceeds a critical level, a severe cleaning failure can occur.

The following disclosures may be relevant to various aspects of the present invention and may be briefly summarized as follows:

Research Disclosure Bulletin, December 1975, No. 14033, page 43, "A Half Tone Screen Cleaning Device" discloses a rail and a screen member which define a slot with a brush member mounted slidably therein. Actuation of a drive motor reciprocates a shaft which reciprocates a brush across the screen member removing particle contaminants therefrom.

U.S. Pat. No. 4,054,381 to Bernhard, discloses a spiral brush mounted for rotation on a shaft centrally located within a housing and a stationary open mesh screen coaxially located with respect to the shaft having a small space being provided between the brush fibers and the screen. Rotation of the spiral brush operates to sift toner through the screen to the outlet of the filter housing while concurrently moving the toner from the input opening toward the discharge opening.

SUMMARY OF INVENTION

Briefly stated, and in accordance with one aspect of the present invention, there is provided an apparatus for removing material from an imaging surface, comprising a brush having a multiplicity of fibers extending outwardly therefrom. And, a housing that defines an open ended chamber, with the brush being mounted movably in the chamber of the housing, with fibers of the brush extending outwardly from the open end of the chamber of the housing in contact with the imaging surface to remove material therefrom. And, a member positioned relative to the fibers of the brush to produce a plurality of impacts thereagainst by each fiber during movement of the brush, dislodging material adhering thereto.

DETAILED DESCRIPTION OF THE INVENTION

Figure 3:
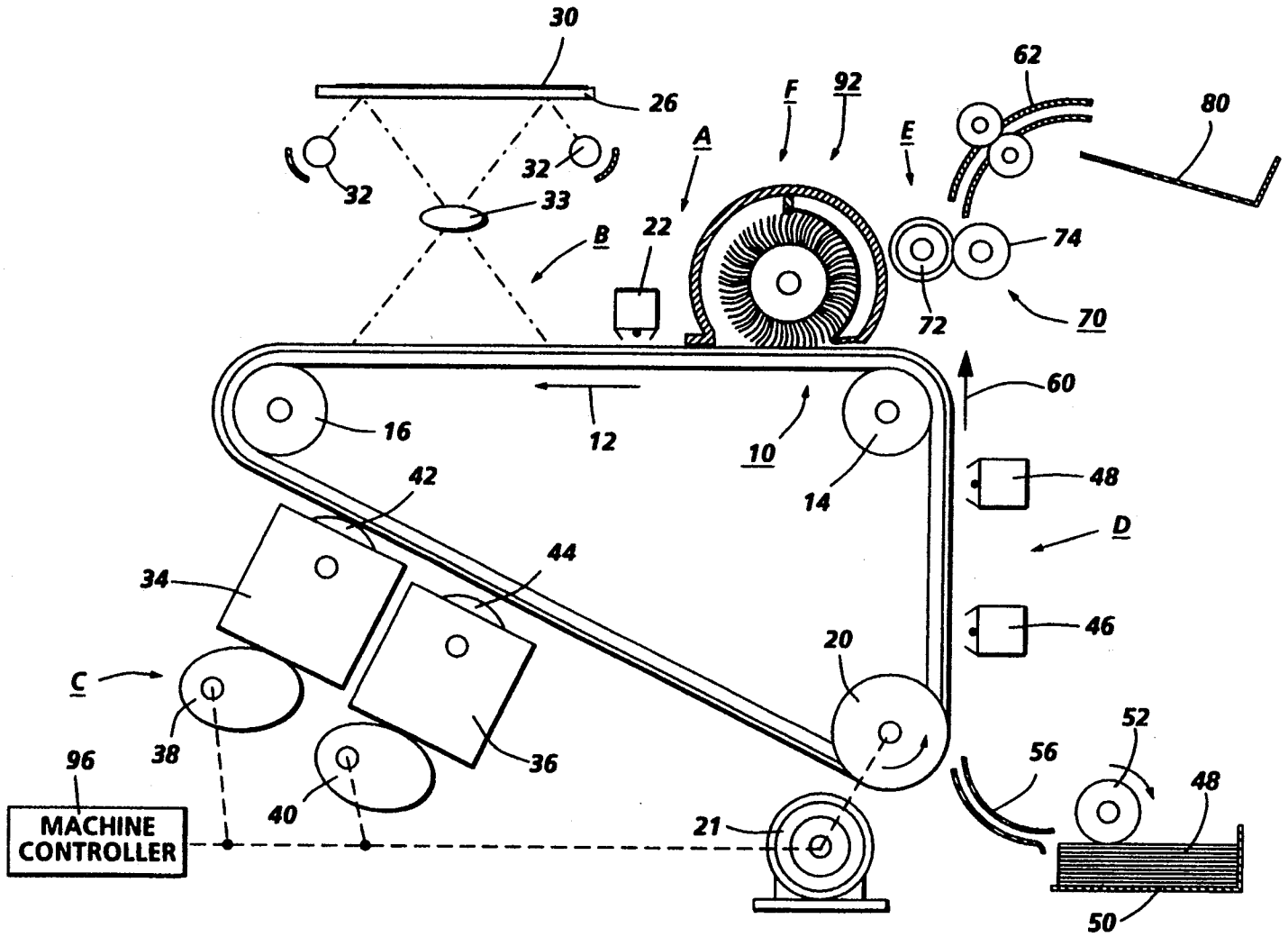
FIG. 3 is a schematic illustration of a printing apparatus incorporating the inventive features of the present invention.

For a general understanding of an electrophotographic printer or copier in which the present invention may be incorporated, reference is made to FIG. 3, which depicts schematically the various components, thereof. Hereinafter, like reference numerals will be employed throughout to designate identical elements. Although the brush cleaner detoner apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 3, will be described briefly hereinafter. It will no doubt be appreciated that the various processing elements also find advantageous use in electrophotographic printing applications from an electronically stored original, and with appropriate modifications, to an ion which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance excessive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 3, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to develop station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner)into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92 which will be described in greater detail in FIGS. 1 and 2. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

Figure 1:
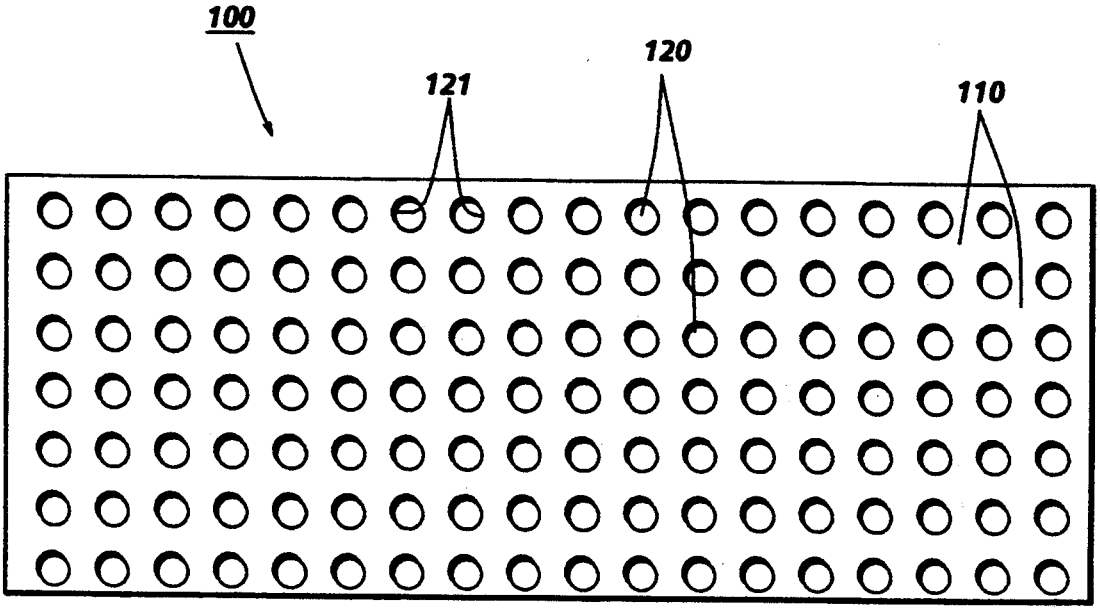
FIG. 1 is an elevational view of the screen of the present invention.
Figure 2:
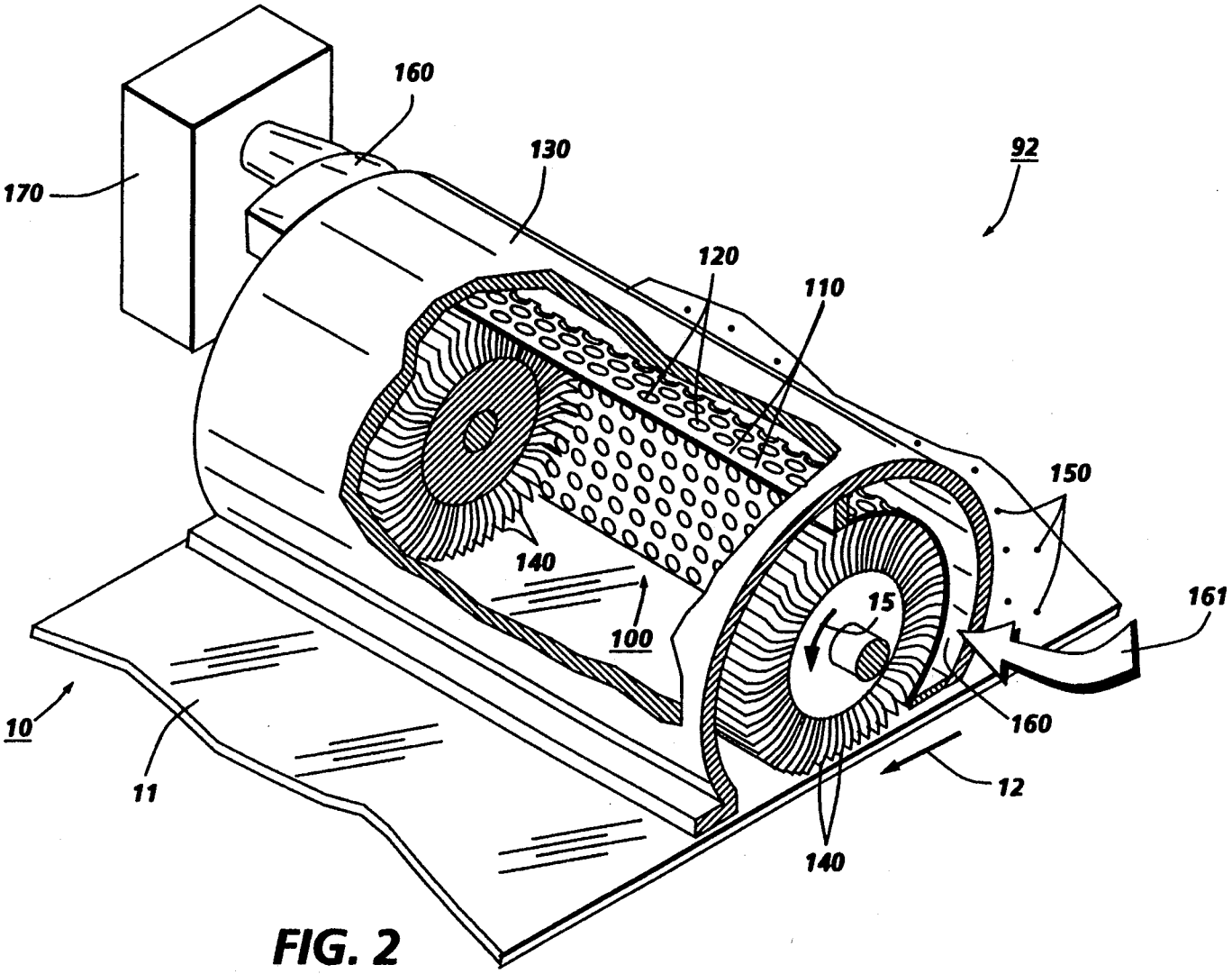
FIG. 2 is a cutaway perspective view of the cleaner housing with the screen of the present invention located therein.

As thus described, a reproduction machine, in accordance with the present invention may be any of several well known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 and 2 where the showings are for the purpose of illustrating preferred embodiments of the present invention and not for limiting the same.

Referring now to FIG. 1, which shows the screen detoning element of the present invention. The process of dislodging charged toner particles from the brush fibers depends on the nature of the fiber-toner contact and the fiber-hole contact. Due to inherent variability in these contacts, between toner laden fibers and the screen, and between toner and the fiber itself, there is an element of randomness in the toner detachment process. In order to achieve a high degree of detoning, the brush fibers must be given several opportunities to detone, each additional opportunity brings the brush fibers closer to 100% detoning. The screen detoning element 100 of the present invention consists of a series of holes 120 in a sheet of material 110 instead of a conventional flicker bar. (The screen can be made of a metallic material and may even be coated with a material such as "Teflon TM".) Each of the holes has an edge 121 where the material ends and the hole 120 begins. The edge around the holes 120 of the screen, act as "micro-flicker bars" and provide several opportunities for fiber-to-hole encounters to further detone the brush fibers. A series of such encounters detones the brush fibers to a level that is not possible with a conventional system (i.e. a single flicker bar).

Referring now to FIG. 2, which shows a break away view of the screen detoning element inside a cleaner housing. The screen 100 is bent to conform to the inside perimeter of the cleaner housing 130, creating an air manifold 160 therebetween. The screen detoning element 100 is located between the inner wall of the cleaner housing 130 and the brush fibers 140. (The brush is rotatably mounted and rotates in the direction of arrow 15.) The space created between the screen 100 and the inner wall of the housing 130, forms the air manifold 160 through which air flows shown by arrow 161. The curvature of the screen 100 is such that the brush fibers 140 are in interference with the screen 100. The screen 100 shown here is connected to the housing 130 at the 12 o' clock position of the housing 130 and at the base of the open end of the housing 130, covering a portion of the brush circumference. (However, the screen can cover a shorter or longer circumference of the brush as desired.) The screen 100 can be attached to the housing 130 in more than one way. For example, the screen 100 may be attached to the housing 130 by screws or other fasteners. Or, the screen may be held in place by inserting edges of the screen into grooves in the housing shell. The "micro-flicker bar" action of the screen 100 further detones the brush fibers 140 detaching toner particles 150 therefrom. The detached toner particles 150 are released into an air manifold connected to the screen 100. The toner particles 150 are carried away, at this point, by an air stream to a filter or separator 170 for further processing.

In recapitulation, the apparatus for detoning a cleaner brush is a screen detoning element located between the inner perimeter of the housing and the brush fibers such that the screen interferes with the brush fibers. The holes in the screen provide multiple opportunities for the flicking action of the brush fibers to take place to further detone the brush fibers. The numerous opportunities for further detoning of the cleaner brush brings the cleaner brush closer to 100% detoning. Furthermore, the screen detoning element of the present invention improves detoning performance inexpensively and efficiently.

It is, therefore, apparent that there has been provided in accordance with the present invention, a screen detoning element that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing material from an imaging surface, comprising:

a brush having a multiplicity of fibers extendinq outwardly therefrom;

a housing defininq an open ended chamber, said brush being mounted movably in the chamber of said housinq with fibers of said brush extending outwardly from the open end of the chamber of said housing in contact with the imaging surface to remove material therefrom;

an air pervious member extending across the chamber of said housing, said member including a sheet-like portion positioned relative to the fibers of said brush to produce a plurality of impacts thereagainst by each fiber during movement of said brush dislodqing material adhering thereto; and means, coupled to said housinq, for generating an air flow adapted to remove material dislodged from the fibers of said brush by impacting against said member, said member being mounted in the chamber of said housing interposed between said brush and said generating means.

2. An apparatus as recited in claim 1, wherein said air pervious member comprises an arcuate member.

3. An apparatus as recited in claim 2, wherein said arcuate member defines a plurality of apertures therein.

4. An apparatus as recited in claim 3, wherein said arcuate member comprises a screen.

5. An apparatus as recited in claim 3, wherein the fibers of said brush impact against the edge region of the apertures of said arcuate member to dislodge material therefrom.

6. An apparatus as recited in claim 3, wherein said housing comprises:

an arcuate inner wall defining a portion of the chamber therein; and said arcuate member substantially conforms to said arcuate inner wall.

7. An apparatus as recited in claim 6, wherein said brush is rotatably mounted in the chamber of said housing.

* * * * *